US010957474B2

(12) United States Patent
Inaba et al.

(10) Patent No.: US 10,957,474 B2
(45) **Date of Patent: *Mar. 23, 2021**

(54) INJECTION CONTROL DEVICE

(71) Applicant: DENSO CORPORATION, Kariya (JP)

(72) Inventors: Masashi Inaba, Kariya (JP); Noboru Nagase, Kariya (JP); Taichi Watanabe, Kariya (JP)

(73) Assignee: DENSO CORPORATION, Kariya (JP)

( * ) Notice: Subject to any disclaimer, the term of this patent is extended or adjusted under 35 U.S.C. 154(b) by 115 days.

This patent is subject to a terminal disclaimer.

(21) Appl. No.: 16/382,438

(22) Filed: Apr. 12, 2019

(65) Prior Publication Data

US 2019/0326044 A1 Oct. 24, 2019

(30) Foreign Application Priority Data

Apr. 20, 2018 (JP) ..... JP2018-081375
Dec. 7, 2018 (JP) ..... JP2018-230007

(51) Int. Cl.
*H01F 7/06* (2006.01)
*F02M 51/00* (2006.01)
*B05B 1/30* (2006.01)

(52) U.S. Cl.
CPC ..... *H01F 7/064* (2013.01); *F02M 51/005* (2013.01); *B05B 1/3053* (2013.01)

(58) Field of Classification Search
CPC ..... F02D 41/365; F02D 41/20; F02D 41/24; F02D 2041/281; F02D 2041/2075; F02D 2041/2013; F02D 2041/2024; F02D 2041/2003; F02M 21/0242
See application file for complete search history.

(56) References Cited

U.S. PATENT DOCUMENTS

2009/0107469 A1* 4/2009 Takahashi ..... F02D 41/20 123/490

FOREIGN PATENT DOCUMENTS

JP 2005-344603 A 12/2005
JP 2016-160920 A 9/2016
JP 2018-093044 A 6/2018

OTHER PUBLICATIONS

U.S. Appl. No. 16/382,549, Apr. 12, 2019, Inaba et al.

* cited by examiner

*Primary Examiner* — Xiao En Mo
(74) *Attorney, Agent, or Firm* — Posz Law Group, PLC

(57) ABSTRACT

An injection control device controls a solenoid in a fuel injection valve. The injection control device includes a transistor on an upstream side of a first power supply path to the solenoid, and a transistor on an upstream side of a second power supply path to the solenoid. The injection control device has another transistor with a body diode arranged in parallel at a position between an upstream terminal of the solenoid and ground. The injection control device also includes a transistor on the downstream side of the first and second power supply paths. A drive controller in the injection control device drives the solenoid to an open position by switching ON the transistor on the downstream side and one of the transistors on the upstream side power supply paths.

6 Claims, 4 Drawing Sheets

INJECTION CONTROL DEVICE

CROSS REFERENCE TO RELATED APPLICATION

The present application is based on and claims the benefit of priority of Japanese Patent Application No. 2018-081375, filed on Apr. 20, 2018, and also of priority of Japanese Patent Application of No. 2018-230007, filed on Dec. 7, 2018, the disclosures of which are incorporated herein by reference.

TECHNICAL FIELD

The present disclosure relates to an injection control device for controlling a solenoid of an injection valve that injects fuel into an internal combustion engine.

BACKGROUND INFORMATION

Vehicles with internal combustion engines may use an injection control device to control the fuel injection to the internal combustion engine. The injection control device controls the opening and closing of one or more solenoids in an electromagnetic valve-type fuel injector to control the injection of fuel into the internal combustion engine. The valve may be driven to an open position by supplying a boosted voltage to the solenoid(s) to initially open the valve, and the valve may then be maintained in an open position by applying a lower battery voltage to the solenoid(s). The boosted voltage may be supplied by a power supply path that is separate from the power supply path used to supply the battery voltage.

When the boosted voltage or normal voltage to the solenoid(s) are stopped to interrupt the forward current flow to the solenoid(s), a reverse current may begin to flow from the solenoid(s) back toward the power supply paths of the boosted voltage and the battery voltage. The injection control device may use a reflux diode to control the flow of the return current.

Problems may arise in the reflux diode. As such, injection control devices are subject to improvement.

SUMMARY

The present disclosure describes an injection control device capable of reducing the heat loss caused by a reflux diode in the injection control device.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Figure 1:
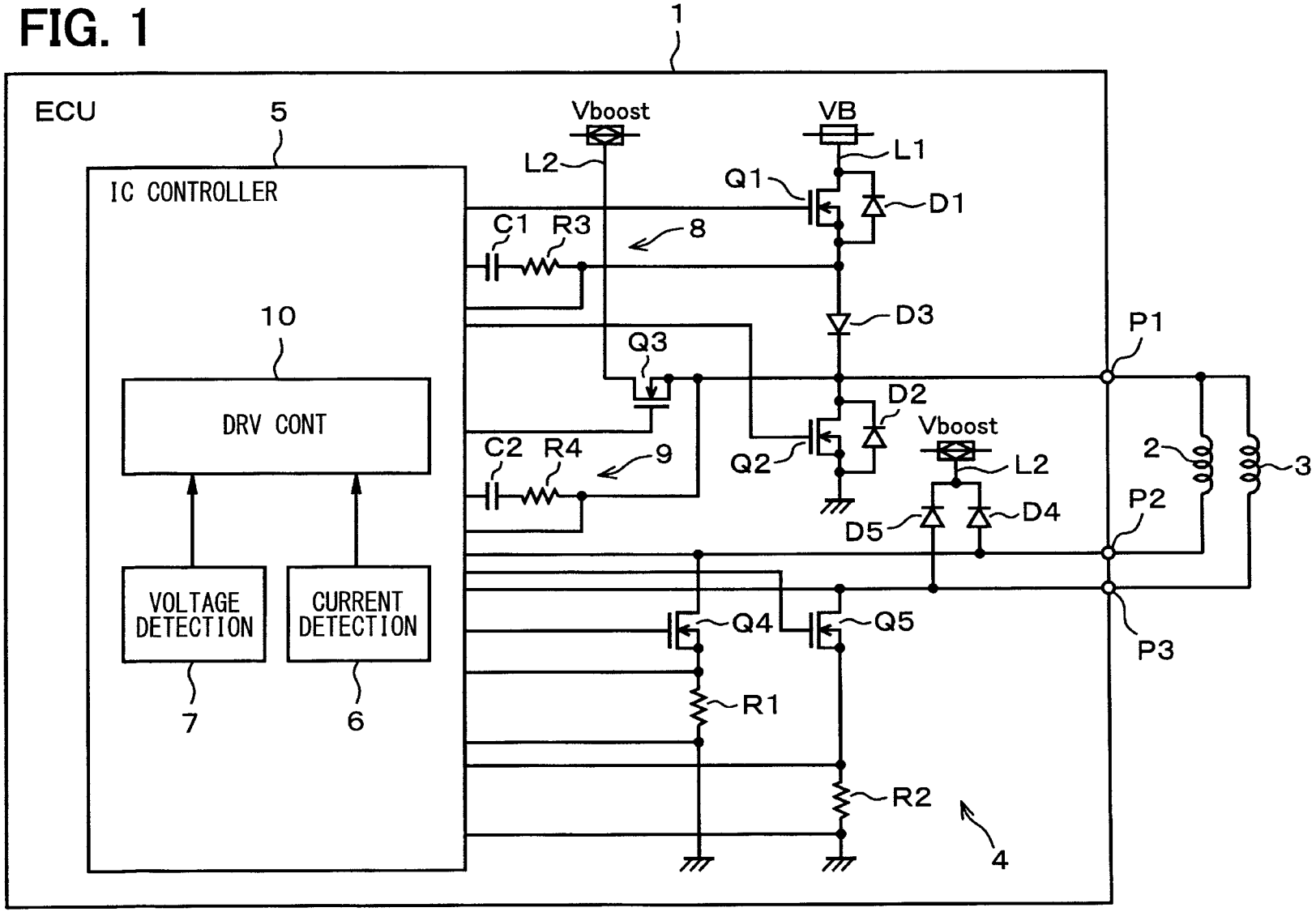
FIG. 1 illustrates a schematic configuration of an injection control device in a first embodiment of the present disclosure.

An injection control device for controlling the fuel injection of an internal combustion engine in a vehicle controls a drive (i.e., operation) of a solenoid in an injection valve to open and close the injection valve. Such an injection control device supplies a peak current to the solenoid by applying a boosted voltage to the solenoid at the start of a preset drive period, where the boosted voltage may be obtained by boosting a battery voltage of the vehicle. By using such a peak current control, the injection valve can be instantly opened (i.e., moved to an open position to begin fuel injection to the engine). After the peak current control, the injection control device supplies a constant current using the battery voltage to drive the solenoid and maintain the injection valve in an open position or open state until the drive period ends.

The injection control device may include a first upstream switch disposed on an upstream side of a first power supply path extending from a direct current (DC) power supply line to the solenoid, where the DC power supply line can supply the solenoid with the battery voltage. The injection control device may also include a second upstream switch provided on an upstream side of a second power supply path extending from a boosted power supply line to the solenoid, where the boosted power supply line may supply the solenoid with the boosted voltage. The battery voltage may be supplied to the solenoid by turning ON the first upstream switch, and the boosted voltage may be supplied to the solenoid by turning ON the second upstream switch.

The injection control device may include a reflux diode to control the flow of a return current that flows from the solenoid when both the first upstream switch and the second upstream switch are turned OFF and the forward current supply to the solenoid from the boosted or battery voltage sources is cut off. The reflux diode may be oriented so that the return current flows through the reflux diode in a forward direction causing a heat loss to occur in the reflux diode. Such a heat loss may be relatively large in proportion to the forward voltage of the reflux diode, and problems may arise in the injection control device as a result of such heat loss.

The embodiments of the present disclosure are described with reference to the drawings. In the following embodiments, like features and elements among the embodiments may be referred to by the same reference numerals, and a repeat description of previously described like features and elements may be omitted from the descriptions of the latter embodiments.

First Embodiment

The first embodiment of the present disclosure is described with reference to FIGS. 1 and 2.

Figure 2:
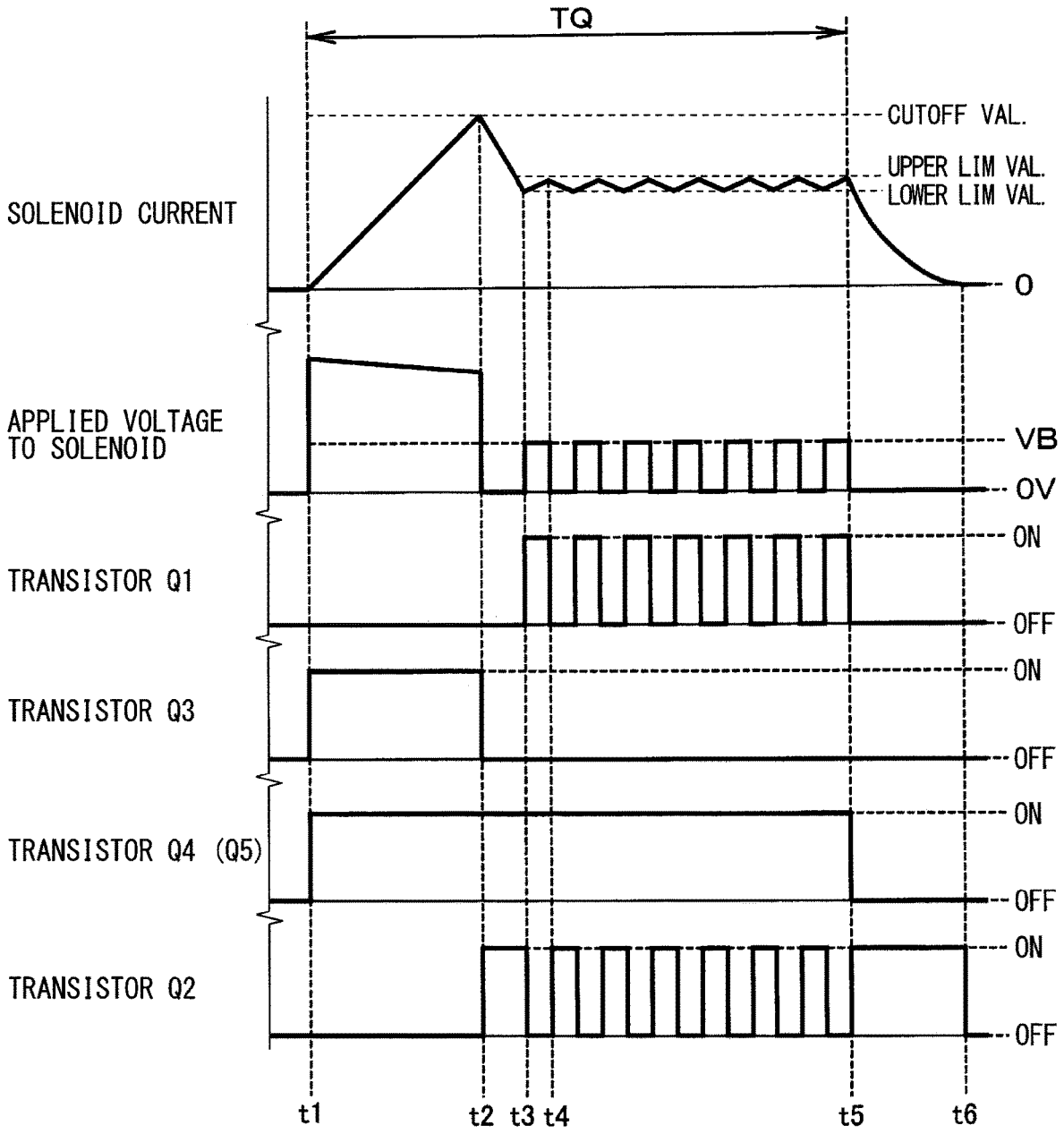
FIG. 2 is a timing chart of a solenoid current, an application voltage to a solenoid, and a drive state of each transistor in the first embodiment.

In FIG. 1, an injection control device 1 is one of a plurality of electronic control devices or electronic control units (ECUs) installed in a vehicle. The electronic control devices may also be referred to as electronic control units (ECUs). The injection control device 1 controls the fuel injection of an internal combustion engine in a vehicle. The injection control device 1 may be referred to simply as an engine ECU 1. The engine ECU 1 integrally controls various actuators based on various sensor signals during various vehicle operations to operate the vehicle in an optimum engine state.

The injection control device 1 controls an operation of an injector that injects pressurized fuel into a cylinder of the engine. More specifically, the injection control device 1 drives or controls a drive of the injector, where "drive" may mean transmitting power or not transmitting power to control the operation of the injector. The injector is a solenoid-type electromagnetic valve with one or more solenoids 2 and 3. The injection control device 1 controls a power supply to solenoids 2 and 3 in the injector to drive the solenoids 2 and 3 (i.e., the valve) to open and closed positions. The terms electromagnetic valve or simply "valve" and solenoid may be used interchangeably. For example, driving the solenoid 2 to an open position may mean driving the valve having the solenoid 2 to an open position.

The injection control device 1 functions to control the drive (i.e., operation) of the solenoids 2 and 3. In FIG. 1, only two solenoids 2 and 3 are illustrated. However, there may be any number of solenoids based on the number of cylinders in the engine. As such, the injection control device 1 may be configured to drive a plurality of solenoids.

A battery voltage VB output from a battery in the vehicle (battery and vehicle both not shown) is supplied to the injection control device 1 via a direct current (DC) power supply line L1. The battery voltage VB is a DC voltage. The injection control device 1 has terminals P1, P2, and P3 for connecting the solenoids 2 and 3. The upstream terminals of the solenoids 2 and 3 are connected to the terminal P1. A downstream terminal of the solenoid 2 is connected to the terminal P2. A downstream terminal of the solenoid 3 is connected to the terminal P3. Upstream and downstream may be used to indicate a position of an element in the injection control device 1 relative to the power supply path of the solenoids 2 and 3, where the power supply path to the solenoids 2 and 3 may be referred to as "upstream," and the return path from the solenoids 2 and 3 may be referred to as "downstream." Similarly, an upstream terminal of the solenoid 2 may refer to the terminal on the power supply side of the solenoid 2 and the downstream terminal of the solenoid 2 may refer to the terminal on the power return side of the solenoid 2.

At the start of a preset drive period, the injection control device 1 performs a peak current control for supplying a peak current to each of the solenoids 2 and 3 to instantly open the valves. After the peak current control, the injection control device 1 then performs a constant current control to supply a constant current that is lower than the peak current to each of the solenoids 2 and 3 until the end of the drive period. The constant current supplied during the constant current control keeps the valve/solenoids 2 and 3 in a valve open state.

The injection control device 1 includes a drive circuit 4 and an integrated circuit (IC) controller 5. The IC controller 5 may be a system on a chip (SoC) integrated circuit-type controller 5 that includes computer and electronic components such as a processor (CPU), memory, input/output (I/O) ports such as terminals, bootstrap diodes, and like components on a single substrate in an integrated circuit package.

The drive circuit 4 includes transistors Q1, Q2, Q3, Q4, and Q5 (i.e., transistors Q1-Q5), diodes D1, D2, D3, D4, and D5, resistors R1, R2, R3, and R4, and capacitors C1 and C2. The transistors Q1-Q5 are N-channel type metal-oxide-semiconductor field-effect transistors (i.e., n-type MOSFETs). Each of the transistors Q1-Q5 has a body diode connected between its drain and source with an anode of the diode positioned on the source side and the cathode of the diode positioned on the drain side. In FIG. 1, only the diodes D1 and D2 that are the respective body diodes for the transistors Q1 and Q2 are shown, while illustrations for the body diodes of transistors Q3, Q4, and Q5 are omitted from FIG. 1.

The drain of the transistor Q1 is connected to the DC power supply line L1 that supplies the battery voltage VB, and the source of the transistor Q1 is connected to the terminal P1 via the diode D3. As shown in FIG. 1, the diode D3 is oriented in the forward direction relative to a first power supply path from the power supply line L1 to the solenoids 2 and 3 that passes through the transistor Q1, the diode D3, and the terminal P1. The transistor Q1 is disposed on an upstream side of the first power supply path extending from the DC power supply line L1 to the solenoids 2 and 3. As such, the transistor Q1 may be referred to as a first upstream switch Q1.

The drain of the transistor Q3 is connected to a boost power supply line L2 that supplies a boost voltage Vboost, and the source of the transistor Q3 is connected to the terminal P1. The boost voltage Vboost may be obtained by boosting the battery voltage VB. The transistor Q3 is also disposed on an upstream side of a second power supply path extending from the boost power supply line L2 to the solenoids 2 and 3. As such, the transistor Q3 may be referred to as a second upstream switch Q3.

The boost voltage Vboost is a voltage for supplying the peak current to the solenoids 2 and 3, and is generated by passing the battery voltage VB through a booster circuit (not shown). For example, the booster circuit may be configured as a boost converter (i.e., a step-up converter) that steps up the input battery voltage VB to generate the boost voltage Vboost as an output.

The diode D3 described above is included in the injection control device 1 to prevent a backflow current (i.e., return current) in the boost power supply line L2 from flowing to the DC power supply line L1 when the boost voltage Vboost is applied to the solenoids 2 and 3. As such, the diode D3 may be referred to as a backflow prevention diode D3. The backflow prevention diode D3 is connected at a position between the upstream terminals of the solenoids 2 and 3 and the transistor Q1 on the first power supply path.

With regard to the body diode D2 of the transistor Q2, the cathode of the diode D2 is connected to the terminal P1, and the anode of the diode D2 is connected to ground (e.g., a return path) at which there is a ground potential of 0 V, that is, a reference potential of the circuit. The diode D2 functions to allow a return current to flow when the current supply to the solenoids 2 and 3 is cut off when both the transistors Q1 and Q3 are turned OFF. As such, the diode D2 is connected at a position between the upstream terminals of the solenoids 2 and 3 and ground, and may be referred to as a reflux diode D2.

The source of the transistor Q2 is connected to ground, and the drain of the transistor Q2 is connected to the terminal P1. The transistor Q2 is disposed in parallel with the reflux diode D2 at a position between the upstream terminals of the solenoids 2 and 3 and ground. As such, the transistor Q2 may be referred to as a short circuit switch Q2.

The drain of the transistor Q4 is connected to the terminal P2, and the source of the transistor Q4 is connected to ground via a resistor R1. The drain of the transistor Q5 is connected to the terminal P3, and the source of the transistor Q5 is connected to ground via a resistor R2. The transistors Q4 and Q5 are disposed downstream of the solenoids 2 and 3. As such, the transistor Q4 may be referred to as a downstream switch Q4 that is downstream (e.g., return path side) of the solenoid 2, and the transistor Q5 may be referred to as a downstream side switch Q5 that is downstream of the solenoid 3.

The IC controller 5 outputs a drive signal to the gate of each of the transistors Q1-Q5, to control the ON and OFF switching of the transistors Q1-Q5. In other words, the transistors Q1-Q5 may be independently driven (i.e., turned ON and OFF) by independent drive signals from the IC controller 5.

The resistors R1 and R2 may be used to respectively detect the electric current flowing through the solenoid 2 and the solenoid 3. As such, the resistors R1 and R2 may respectively be referred to as the shunt resistor R1 and the shunt resistor R2. The terminal voltages of the shunt resistors R1 and R2, that is, the inter-terminal voltage or voltage between the terminals of the resistors R1 and R2, are respectively input to the IC controller 5.

The IC controller 5 includes a current detection unit 6. The current detection unit 6 may include, for example, an amplifier circuit (not shown). The current detection unit 6 detects a solenoid current, that is, a current flowing through the solenoid 2, based on a voltage obtained by amplifying the terminal voltage of the resistor R1. The current detection unit 6 also detects a solenoid current of the solenoid 3 based on a voltage obtained by amplifying the terminal voltage of the resistor R2.

The voltages at the terminals P1, P2, and P3 are each input to the IC controller 5. The IC controller 5 includes a voltage detection unit 7. The voltage detection unit 7 may include, for example, a voltage dividing circuit (i.e., a voltage divider, not shown). The voltage detection unit 7 detects the voltages at each of the upstream terminals of the solenoids 2 and 3 by dividing the voltage obtained at the terminal P1. The voltage detection unit 7 can also detects the voltage at the downstream terminal of the solenoid 2 by dividing the voltage at the terminal P2, and detect the voltage at the downstream terminal of the solenoid 3 by dividing the voltage at the terminal P3. The voltage detection unit 7 can detect an application voltage to the solenoids 2 and 3 based on the detected voltages at the upstream terminals and the downstream terminals of the solenoids 2 and 3. Consequently, because the voltage detection unit 7 can detect the voltages at the terminals P1, P2, and P3, and detect the application voltage applied to the solenoids 2 and 3, the voltage detection unit 7 may be referred to as both a terminal voltage detector 7 and an application voltage detector 7.

The anode of the diode D4 is connected to the terminal P2, and the cathode of the diode D4 is connected to the boost power supply line L2. The anode of the diode D5 is connected to the terminal P3, and the cathode of the diode D5 is connected to the boost power supply line L2. In other words, the diodes D4 and D5 are connected at positions between (i) the boost power supply line L2 and (ii) the downstream terminals of the solenoids 2 and 3, respectively, with the anodes of diodes D4 and D5 respectively connected to the downstream terminals of the solenoids 2 and 3. The diodes D4 and D5 direct the electric current flowing through the solenoids 2 and 3 back to the boost power supply line L2 and further to a capacitor in the booster circuit (not shown) when the transistors Q4 and Q5 are turned OFF. As such, the diodes D4 and D5 may be referred to as regeneration diodes D4 and D5.

One terminal of the capacitor C1 is connected to a bootstrap terminal of the IC controller 5 and the other terminal of the capacitor C1 is connected to the source of the transistor Q1 via the resistor R3. The source of the transistor Q1 is connected to the bootstrap terminal of the IC controller 5 via a bootstrap circuit 8. The capacitor C1 and the resistor R3 together with a diode in the IC controller 5 (diode not shown) make up the bootstrap circuit 8 for generating an ON drive voltage for driving the transistor Q1 to ON. In other words, the bootstrap circuit 8 is used for turning ON the transistor Q1.

One terminal of the capacitor C2 is connected to another bootstrap terminal of the IC controller 5 and the other terminal of the capacitor C2 is connected to the source of the transistor Q3 via a resistor R4. The source of the transistor Q3 is connected to the bootstrap terminal of the IC controller 5 via a bootstrap circuit 9. The capacitor C2 and the resistor R4 together with a diode in the IC controller 5 (diode not shown) make up the bootstrap circuit 9 for generating an ON drive voltage for driving the transistor Q3 to ON.

A drive controller 10 of the IC controller 5 controls an operation of the drive circuit 4. That is, the drive controller 10 in the IC controller 5 controls the ON and OFF switching of each of the transistors Q1-Q5 based on instructions from an external computer (not shown), the current detected by the current detection unit 6, and the voltage detected by the voltage detection unit 7. Specifically, the IC controller 5 selects one of the plurality of solenoids to be energized based on an instruction given from the external computer, and turns ON (i.e., performs an ON driving control of) one of the transistors Q4 and Q5 that corresponds to the selected solenoid during the preset drive period.

The IC controller 5 then drives the transistor Q3 to ON during the period when the peak current control is performed, and repeatedly drives the transistor Q1 ON and OFF during the period when the constant current control is performed. During such a drive operation, the IC controller 5 controls the drive of the transistors Q1 and Q3 so that the solenoid current has a desired current value based on the current detected by the current detection unit 6.

In such manner, the drive controller 10 turns ON the transistor Q4 and one of the transistors Q1 and Q3 to drive the solenoid 2, and turns ON the transistor Q5 and one of the transistors Q1 and Q3 to drive the solenoid 3.

Since the transistor Q1 is an n-type MOSFET, a drive voltage higher than the battery voltage VB is required to drive the transistor Q1 to ON. However, the power supply voltage supplied to the IC controller 5 is, for example, 5 V, which is lower than the battery voltage VB. Consequently, the drive controller 10 in the IC controller 5 generates the ON drive voltage for the transistor Q1 by using the above-described bootstrap circuit 8.

Similarly, since the transistor Q3 is an n-type MOSFET, a voltage higher than the boost voltage Vboost is required to drive the transistor Q3 to ON. However, the power supply voltage supplied to the IC controller 5 is, for example, 5 V, which is lower than the boost voltage. Consequently, the drive controller 10 generates the ON drive voltage for the transistor Q3 by using the above-described bootstrap circuit 9.

The operation of the injection control device 1 is described with reference to FIG. 2. While FIG. 2 and the accompanying description describes the control logic for driving the solenoid 2 to open the electromagnetic valve of solenoid 2, a similar control logic may also be used to drive the solenoid 3.

When the preset drive period TQ begins at time t1, the drive controller 10 turns ON the transistors Q3 and Q4. As a result, the boost voltage Vboost is applied to the solenoid 2, and the solenoid current starts to increase. The drive controller 10 also drives the transistor Q2 to OFF at time t1. In other words, the drive controller 10 turns OFF the transistor Q2 at time t1 or maintains the transistor Q2 in an OFF state at time t1 if the transistor Q2 is already OFF at time t1. As a result of turning OFF the transistor Q2, the diode D2 functions in a non-short circuited state, that is, as if there is not a short circuit between the terminals of the diode (e.g., functions as an open circuit equivalent).

At time t2, the drive controller 10 turns the transistor Q3 OFF when the solenoid current reaches a cutoff current value. The cutoff current value may be set based on a target value of the peak current. As a result of driving the transistor Q3 to OFF, the application voltage to the solenoid 2 becomes 0 V at time t2, and the solenoid current starts to decrease. In such manner, the period from time t1 to time t2 when the transistor Q3 is driven to ON to perform the peak current control may be referred to as the discharge period.

During the discharge period from time t1 to time t2, the drive controller 10 drives the transistor Q2 to OFF. In other words, the drive controller 10 drives the transistor Q2 to OFF when the transistor Q3 is driven to ON. As shown in FIG. 2, the application voltage to the solenoid 2 gradually decreases during the discharge period due to the discharge of the capacitor in the booster circuit.

After the discharge period, the drive controller 10 performs a constant current control and repeatedly drives the transistor Q1 ON and OFF during the constant current control period (e.g., from time t3 to time t5) until the end of the drive period TQ. During the constant current control period, the solenoid 2 is supplied with a constant current to keep the electromagnetic valve open (i.e., maintain the valve in a valve open state). Specifically, after the discharge period has elapsed, the drive controller 10 drives the transistor Q1 to ON when the solenoid current decreases to a constant current lower limit value (e.g., at time t3). As a result of switching the transistor Q1 ON, the battery voltage VB is applied to the solenoid 2 and the solenoid current begins to increase.

The drive controller 10 drives the transistor Q1 to OFF when the solenoid current increases to a constant current upper limit value (e.g., at time t4). As a result of turning off the transistor Q1, the application voltage to the solenoid 2 becomes 0 V and the solenoid current begins to decrease. By repeating such an ON and OFF control of the transistor Q1, a constant current can be supplied to the solenoid 2 to maintain the valve in an open position/open state.

At time t2, the drive controller 10 drives the transistor Q2 to ON when the solenoid current reaches the cutoff current value and drives the transistor Q3 to OFF. After the peak current control ends, the drive controller 10 repeatedly drives the transistor Q2 ON and OFF during the constant current control period until the drive period TQ ends. During the drive period TQ, the drive controller 10 drives the transistor Q2 to OFF when the solenoid current falls to the constant current lower limit value, (e.g., at time t3). The drive controller 10 drives the transistor Q2 to ON when the solenoid current rises to reach the constant current upper limit value (e.g., at time t4).

The drive controller 10 drives the transistors Q1, Q3 and Q4 to OFF at time t5 when the drive period TQ ends. When the drive controller 10 turns OFF the transistors Q1, Q3, and Q4 at time t5, as time begins to lapse after time t5, the solenoid current begins to decrease until reaching zero at time t6. When the solenoid current reaches zero at time t6, the electromagnetic valve of the solenoid 2 fully closes (i.e., is put in a closed state). The drive controller 10 drives the transistor Q2 to OFF at time t6 when the solenoid current is equal to zero. When current is supplied to the solenoid 2, that is, during the drive period TQ, the electric current flowing through the solenoid flows in a forward direction. When the current supply to the solenoid is interrupted, a return current flows from the solenoid 2. When both the transistors Q1 and Q3 are turned OFF and the current supply to the solenoid 2 is cut off (i.e., interrupted), the drive controller 10 drives the transistor Q2 to ON. As a result, when the current supply to the solenoid 2 is interrupted, the diode D2 functions in a short circuited state (i.e., as if there is a short circuit between both ends of the diode where the diode functions as a short circuit equivalent), and the return current flows through the transistor Q2 that has been turned ON. Electric current flowing in the solenoid 2 in the forward direction means that the electric current flows from an upstream terminal to a downstream terminal of the solenoid 2.

During the drive period TQ, the amount of time Ts the transistor Q2 is turned ON and the diode D2 functions in a short circuited state can be calculated by Equation (1), where the sum of Tq1 and Tq3 is subtracted from the total duration of the drive period TQ. In Equation (1), Tq1 is the amount of time transistor Q1 is turned ON during the drive period TQ and Tq3 is the amount of time transistor Q3 is turned ON during the drive period TQ.

$$Ts = TQ - (Tq1 + Tq3) \quad \text{Equation (1)}$$

The present embodiment described above can achieve and realize the following advantageous effects. In the injection control device 1 of the present embodiment, when the transistor Q1 and the transistor Q4 or Q5 are turned ON, the battery voltage VB is applied to the solenoid 2 or 3. When the transistor Q3 and the transistor Q4 or Q5 are turned ON, the boost voltage Vboost is applied to the solenoid 2 or 3. When the transistor Q2 is turned OFF, the diode D2 is put in a non-short circuited state, and when the transistor Q2 is turned ON the diode D2 functions in a short circuited state.

During the drive period TQ from time t1 to t5, when the transistors Q1 and Q3 are turned ON, the current flowing through the solenoid flows in a forward direction. When the transistors Q1 and Q3 are turned OFF, the transistor Q2 is turned ON. In such manner, when the current supply to the solenoids 2 and 3 is interrupted, a return current from the solenoids 2 and 3 flows through the transistor Q2 that has been turned ON. As such, substantially no current flows through the diode D2 (i.e., in a forward direction) during the flow of the return current, and consequently, the diode D2 does not generate heat and contribute to any heat loss in the injection control device 1. That is, very little, if any return current flows through the diode D2 when the transistor Q2 is turned ON, and the diode D2 does not cause any heat loss from the return current flowing through the diode D2. While heat loss may still be caused by the return current flow through the transistor Q2, such heat loss by the transistor Q2 is much smaller than heat loss by the diode D2, because the transistor Q2 is a MOSFET.

As a result, based on the above-described configuration, the injection control device 1 of the current embodiment can more effectively reduce the effects of heat loss compared to the injection control devices in related technologies. As the current supplied to the solenoids 2 and 3 increases, the effects of heat loss also increase and become more noticeable. Consequently, in larger engines with larger engine capacities and higher performances that use a greater amount of current to drive the solenoids 2 and 3, the heat loss reduction effects exhibited by the injection control device 1 of the current embodiment can become even more beneficial, with the advantageous heat-loss-reducing effects of the current embodiment also becoming more noticeable.

When the electric current flows through the solenoids 2 and 3 in a forward direction, the drive controller 10 drives the transistor Q2 to OFF when at least one of the transistors Q1 and Q3 is turned ON, by performing an ON and OFF control of the transistors Q1, Q2, and Q3. If the transistor Q2 is turned ON while the transistor Q1 or Q3 is being turned ON, an excessive short circuit-like current may flow from the DC power supply line L1 or from the boost power supply line L2 to ground. However, by controlling the ON and OFF of the transistors Q1, Q2, and Q3 so that Q2 is switched OFF when the transistors Q1 or Q3 are switched ON, such an excessive current flow to ground can be prevented.

The injection control device 1 includes the diodes D4 and D5 for regenerating an electric current flowing through the solenoids 2 and 3 back to the boost power supply line L2 when the transistors Q4 and Q5 are turned OFF. Then, the drive controller 10 drives both of the transistors Q1 and Q3 to OFF when the transistors Q4 and Q5 are turned OFF, by performing an ON and OFF control of the transistors Q1 and Q3. By turning OFF the transistors Q1 and Q3 when the transistors Q4 and Q5 are turned OFF, the injection control device 1 of the current embodiment can effectively realize and achieve current regenerating effects.

The control logic of the present embodiment can be modified as follows. That is, the drive controller 10 may turn the transistor Q2 to OFF when the voltage detection unit 7 detects an application voltage to the solenoids 2 and 3 that is greater than zero (0 V). Similarly, the drive controller may turn the transistor Q2 to ON when the voltage detection unit 7 detects an application voltage that is equal to or less than zero (0 V). Even by using this modified control scheme for turning the transistor Q2 ON and OFF, the amount of time where the transistor Q2 is turned ON during the drive period TQ is substantially the same as the time Ts calculated using equation (1).

Alternatively, the drive controller 10 may turn the transistor Q2 ON when the voltage detection unit 7 detects that the voltage at the upstream terminals of the solenoids 2 and 3 is lower than the voltage at the downstream terminals of the solenoids 2 and 3. Even by using this modified control scheme for turning the transistor Q2 ON, the amount of time where the transistor Q2 is turned ON during the drive period TQ is substantially the same as the time Ts calculated using equation (1).

Advantageous effects similar to those achieved and realized by the above-described embodiment can also be achieved by using the above-described example modifications to the control logic. In each of the above-described modifications, the transistor Q2 is controlled based on the detected value of the application voltage to the solenoids 2 and 3, or the detected value of the voltage at the upstream and downstream terminals of the solenoids 2 and 3. By using the above-described modifications, the return current flow may be better controlled by using the transistor Q2 compared to cases where the transistor Q2 is controlled based on the detection value of the solenoid current. As a result, the example control modifications for the transistor Q2 can achieve even better heat loss reduction effects.

Second Embodiment

Figure 3:
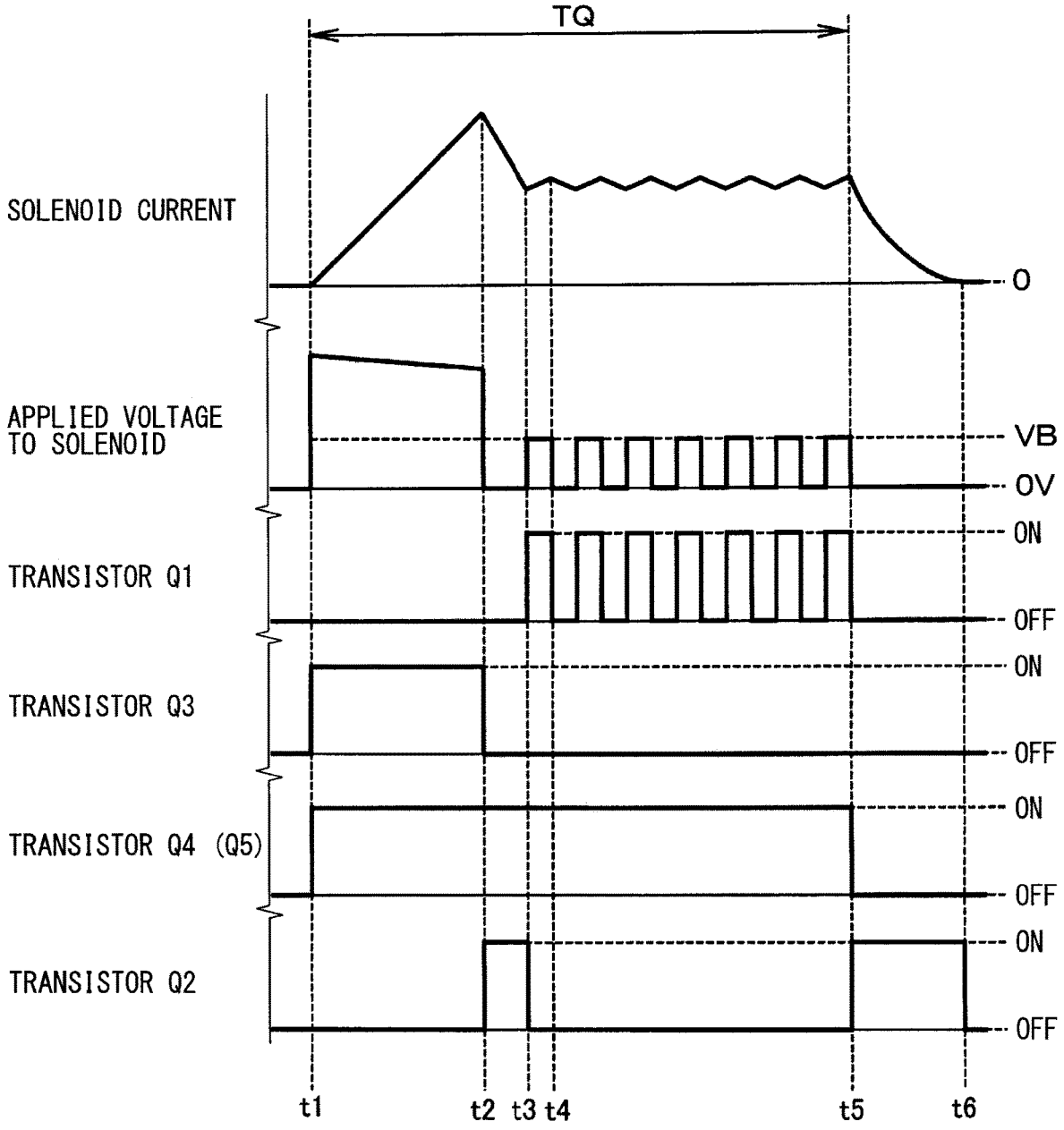
FIG. 3 is a timing chart of a solenoid current, an application voltage to a solenoid, and a drive state of each transistor in a second embodiment of the present disclosure.

The second embodiment of the present disclosure is described with reference to FIG. 3. The description of the second embodiment focuses on the differences from the first embodiment in the control logic for driving the solenoids 2 and 3. In the second embodiment, the configuration of the injection control device 1 is the same as the configuration of the injection control device 1 in the first embodiment, as shown in FIG. 1.

For the control logic in the present embodiment, the ON and OFF control of the transistor Q2 is different from the control logic in the first embodiment. In the present embodiment, the drive controller 10 drives the transistor Q2 to OFF during the discharge period from time t1 to time t2, and drives the transistor Q2 to ON at time t2 when the discharge period ends, just like the first embodiment.

The drive controller 10 then drives the transistor Q2 to OFF when the solenoid current falls to the constant current lower limit value for the first time at time t3. After time t3, the drive controller 10 keeps the transistor Q2 turned OFF until at least the end of the drive period TQ. In the present embodiment, the transistor Q2 is turned from OFF to ON at time t2 and turned from ON to OFF at time t3. The ON time Ts of the transistor Q2 during the drive period TQ, where the diode D2 functions as if in a short circuited state, can be calculated by equation (2). In equation (2), the time (i.e., duration) of the discharge control (e.g., from time t1 to time t2) is given as Td, and the time of the constant current control (e.g., from time t3 to time t5) is given by Tc. The ON time Ts for the transistor Q2 can be calculated by subtracting the sum of the times for the discharge control Td and the constant current control Tc from the total duration of the drive period Tq.

$$Ts=TQ-(Td+Tc) \quad \text{Equation (2)}$$

Since the transistor Q2 is turned ON when both the transistors Q1 and Q3 are turned OFF, the same effects realized by the first embodiment for reducing heat loss during a reverse current flow can also be achieved by the second embodiment. In such a case, even though the return current flows through the transistor Q2 when the transistor Q2 is turned ON during a transition between the peak current control and the constant current control, the return current flows through the diode D2 during the constant current control period when the transistor Q1 is turned OFF.

In the above-described transition period, the return current may be a relatively large current, because the return current is caused by the relatively high boost voltage Vboost applied to the solenoids 2 and 3 during the discharge control. Significant heat reduction effects may also be realized by the control performed in the present embodiment as compared to the controls of injection control devices in related technologies, even though the control of the present embodiment allows the return current to only flow through the transistor Q2 in the transition period between the discharge and constant current controls, because the return current during the transition period is relatively large.

Third Embodiment

Figure 4:
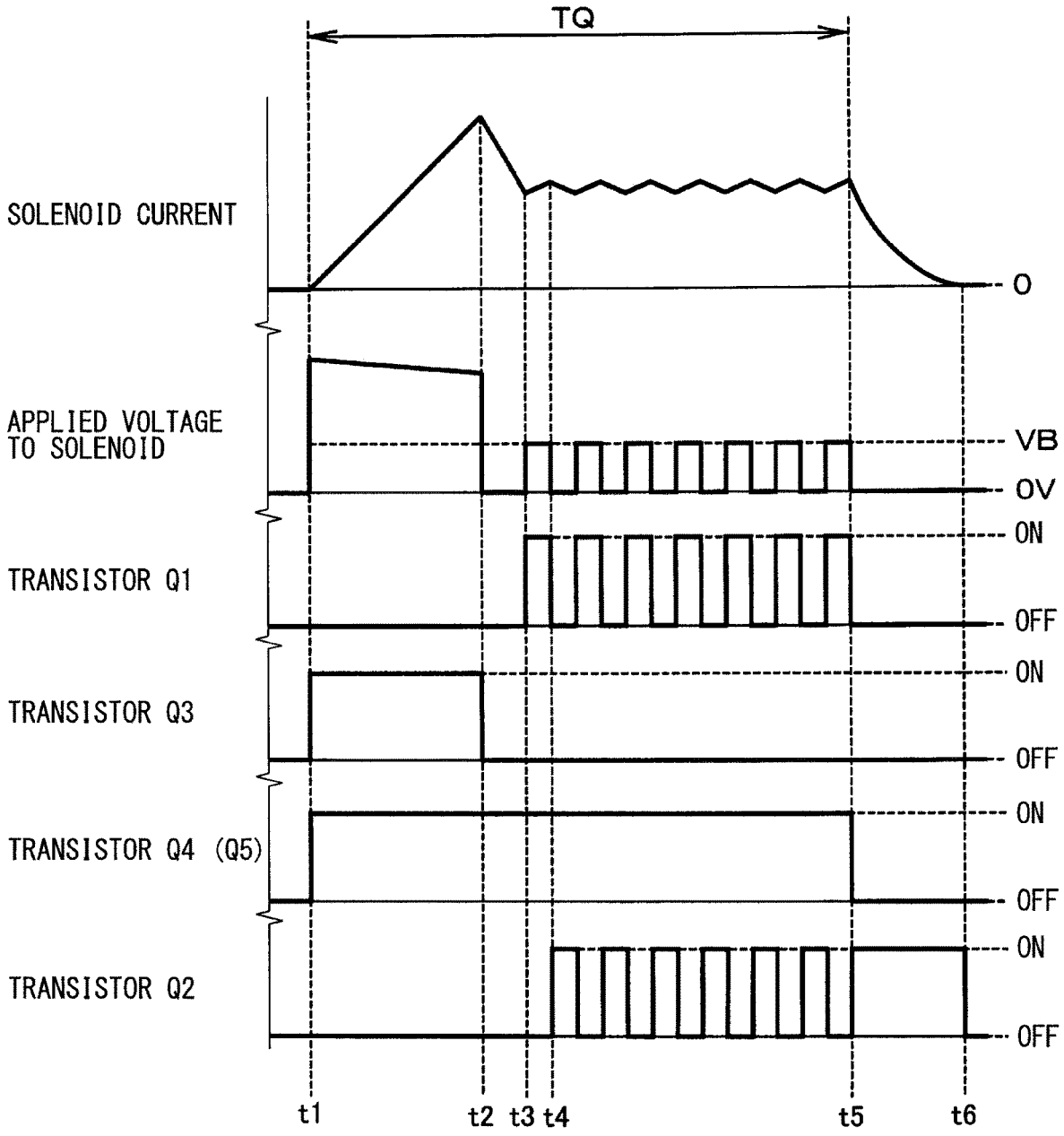
FIG. 4 is a timing chart of a solenoid current, an application voltage to a solenoid, and a drive state of each transistor in a third embodiment of the present disclosure.

The third embodiment of the present disclosure is described with reference to FIG. 4. The description of the third embodiment focuses on the differences from the previous embodiments in the control logic for driving the solenoids 2 and 3. In the third embodiment, the configuration of the injection control device 1 is the same as the configuration of the injection control device 1 in the first embodiment, as shown in FIG. 1.

For the control logic in the present embodiment, the ON and OFF control of the transistor Q2 is different from the control logic in the previous embodiments. In the present embodiment, the drive controller 10 turns OFF the transistor Q2 during the discharge period from time t1 to time t2, just like the previous embodiments. However, in the current embodiment, the drive controller 10 turns OFF the transistor Q2 during the transition period from time t2 to time t3 where the control transitions from the peak current control to the constant current control.

After the transition period ends at time t3, the drive controller 10 drives the transistor Q2 ON and OFF during the constant current period from time t3 to time t5 until the drive period TQ ends, similar to the control performed during the constant current period of the first embodiment. The ON time Ts where the transistor Q2 is turned ON during the drive period TQ and the diode D2 functions as if in a short circuited state can be calculated by equation (3). In equation (3), the time (i.e., duration) of the discharge control is given as Tq3, which is the ON time of the transistor Q3, the time for the transition period (e.g., from time t2 to time t3) is given as Tt, and the total ON time for the transistor Q1 during the drive period TQ is given as Tq1. The total ON time Ts for the transistor Q2 the during the drive period TQ can be calculated by subtracting the sum of the transition period Tt, the ON time of the transistor Q1 Tq1, and the ON time of the transistor Q3 Tq3 from the total duration of the drive period TQ.

$$Ts=TQ-(Tt+Tq1+Tq3) \quad \text{Equation (3)}$$

Since the transistor Q2 is turned ON when both of the transistors Q1 and Q3 are turned OFF, the same effects realized by the previous embodiments for reducing heat loss during a reverse current flow can also be realized and achieved by the third embodiment. In such a case, even though the return current flows through the transistor Q2 when the transistor Q2 is turned ON during the constant current control period from time t3 to time t5, the return current still flows through the diode D2 during the transition period from the peak current control to the constant current control.

Generally, the duration of the constant current control period is longer than the transition period. As such, any heat produced by the diode D2 during the transition period may be negligible relative to the heat reduction effects during the constant current control period. Significant heat reduction effects may also be realized by the control performed in the present embodiment as compared to the controls of the injection control devices in related technologies, even though the control of the present embodiment allows the return current to only flow through the transistor during the constant current control period, because the duration of the constant current control period is relatively long compared to the transition period.

Other Embodiments

The present disclosure is not limited to the embodiments described above and illustrated in the drawings, and can be arbitrarily modified, combined, or expanded without departing from the scope of the injection control device described in the description. Numerical values given in the above embodiments are examples only, and are not intended to be limiting.

The present disclosure is not limited to an injection control device in an engine ECU that controls the fuel injection of an engine, but can also be applied generally to an injection control device that controls the drive of a solenoid of a high-pressure pump for pressurizing fuel to an internal combustion engine. In other words, the above-described embodiments are not limited to use in an engine ECU.

The transistors Q1, Q2, Q3, Q4, and Q5 are not limited to n-type MOSFETs, and various types of semiconductor switching elements can also be used. The reflux diode is not limited to the diode used as the body diode of the transistor Q2, and one or more additional diodes may be used as reflux diodes.

The drive controller 10 may drive the transistor Q2 to OFF in a period from time t5 to time t6 after the drive period TQ ends, e.g., as the solenoid current falls to zero. In such cases where the drive controller 10 turns the transistor Q2 OFF, the return current flows through the diode D2 in the period from time t5 to time t6. During this period where the solenoid current decreases toward zero, the return current is also relatively small. Consequently, by turning OFF the transistor Q2 in the period from time t5 to time t6, the injection control device 1 of the present disclosure can achieve and realize less heat loss than the than injection control devices in related technologies Although the present disclosure has been described in accordance with the embodiments, it should be understood that the present disclosure is not limited to those embodiments and structures described herein. The present disclosure covers various modification examples and equivalent arrangements. Furthermore, various combinations of the embodiments, where such combinations may add additional elements to the combination or remove elements from the combination, are understood to be included within the scope of the present disclosure.

What is claimed is:

1. An injection control device for controlling a solenoid in an injection valve that injects fuel into an internal combustion engine, the injection control device comprising:

a first upstream switch disposed on an upstream side of a first power supply path that extends from a direct current (DC) power supply line to the solenoid, the DC power supply line configured to supply a DC voltage to the solenoid;

a second upstream switch disposed on an upstream side of a second power supply path that extends from a boost power supply line to the solenoid, the boost power supply line configured to supply a boosted voltage to the solenoid, the boosted voltage obtained by boosting the DC voltage;

a downstream switch disposed on a downstream side of the first and second power supply paths;

a reflux diode disposed at a position between an upstream terminal of the solenoid and ground, an anode of the reflux diode connected to ground;

a short circuit switch disposed at a position between the upstream terminal of the solenoid and ground, the short circuit switch arranged in parallel with the reflux diode; and a drive controller configured to control a drive of the solenoid by controlling an ON and OFF switching of the first upstream switch, the second upstream switch, the downstream switch, and the short circuit switch, the drive controller further configured to drive the solenoid to an open position by switching ON the downstream switch and one of the first upstream switch and the second upstream switch.

2. The injection control device of claim 1, wherein the drive controller is further configured to switch OFF the short circuit switch when a forward current flows through the solenoid in a forward direction and the one of the first upstream switch and the second upstream switch is switched ON.

3. The injection control device of claim 1 further comprising:

a regeneration diode disposed at a position between the boost power supply line and a downstream terminal of the solenoid, the regeneration diode having an anode connected to the downstream terminal of the solenoid, wherein the drive controller is further configured to switch the one of the first upstream switch and the second upstream to OFF when the downstream switch is switched OFF.

4. The injection control device of claim 1 further comprising:

an application voltage detector configured to detect an application voltage applied to the solenoid, wherein the drive controller is further configured to switch the short circuit switch to OFF when the application voltage detected by the application voltage detector is a voltage greater than zero.

5. The injection control device of claim 1 further comprising:

an application voltage detector configured to detect an application voltage applied to the solenoid, wherein the drive controller is further configured to switch the short circuit switch ON when the application voltage detected by the application voltage detector is a voltage less than or equal to zero.

6. The injection control device of claim 1 further comprising:

a terminal voltage detector configured to detect a terminal voltage of the solenoid, wherein the drive controller is further configured to switch the short circuit switch ON when the terminal voltage detector detects that a voltage at the upstream terminal of the solenoid is less than a voltage at the downstream terminal of the solenoid.

* * * * *